US011920850B2

(12) United States Patent
Mi et al.

(10) Patent No.: US 11,920,850 B2
(45) Date of Patent: Mar. 5, 2024

(54) AIR DUCT SYSTEM AND A REFRIGERATION APPLIANCE HAVING THE SAME

(71) Applicants: QINGDAO HAIER REFRIGERATOR CO., LTD., Qingdao (CN); HAIER SMART HOME CO., LTD., Qingdao (CN)

(72) Inventors: Bo Mi, Qingdao (CN); Qihai Du, Qingdao (CN); Zhenyu Zhao, Qingdao (CN); Guoliang Mou, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 68 days.

(21) Appl. No.: 17/615,829

(22) PCT Filed: Mar. 3, 2020

(86) PCT No.: PCT/CN2020/077546
§ 371 (c)(1),
(2) Date: Dec. 1, 2021

(87) PCT Pub. No.: WO2021/008140
PCT Pub. Date: Jan. 21, 2021

(65) Prior Publication Data

US 2022/0325939 A1 Oct. 13, 2022

(30) Foreign Application Priority Data

Jul. 17, 2019 (CN) ..... 201910647038.0

(51) Int. Cl.
*F25D 17/04* (2006.01)
*F25D 17/06* (2006.01)
(Continued)

(52) U.S. Cl.
CPC ..... *F25D 17/042* (2013.01); *F25D 17/062* (2013.01); *F25D 21/04* (2013.01);
(Continued)

(58) Field of Classification Search
CPC ..... F25D 2317/0411; F25D 21/04; F25D 17/042; F25D 17/062; F25D 21/14;
(Continued)

(56) References Cited

U.S. PATENT DOCUMENTS 2,143,188 A * 1/1939 Coulter ..... F25D 17/042 62/409
2014/0251437 A1* 9/2014 Raye ..... B60T 17/04 137/561 R

FOREIGN PATENT DOCUMENTS

CN 102116557 A 7/2011
CN 202326234 U 7/2012
(Continued)

OTHER PUBLICATIONS

English language translation of DE 10-2011050691 to Koeckritz et al. Translated Apr. 2023. (Year: 2012).*
(Continued)

*Primary Examiner* — Cassey D Bauer
(74) *Attorney, Agent, or Firm* — Cheng-Ju Chiang

(57) ABSTRACT

Provided in the present application are an air duct system and a refrigeration appliance provided having the same. The air duct system comprises a drying system and a cooling system arranged in cooperation with each other, the cooling system has an evaporator and an air return port and an air supply port arranged on the two sides of the evaporator, and the drying system is disposed between the air return port and the evaporator, and comprises an air compressor and an air storage tank connected to each other; the air discharged by the air return port passes in sequence through the air
(Continued)

compressor and the air storage tank and then flows to the evaporator, so that the air passing through the evaporator is dried, avoiding the problems of frosting and low efficiency.

12 Claims, 2 Drawing Sheets

(51) Int. Cl.
*F25D 21/04* (2006.01)
*F25D 21/14* (2006.01)
*F25D 23/00* (2006.01)

(52) U.S. Cl.
CPC ..... *F25D 21/14* (2013.01); *F25D 23/006* (2013.01); *F25D 2317/0411* (2013.01); *F25D 2317/0415* (2013.01); *F25D 2317/0671* (2013.01); *F25D 2317/0672* (2013.01)

(58) Field of Classification Search
CPC ..... F25D 23/006; F25D 2317/0415; F25D 2317/0671; F25D 2317/0672; F24F 2003/144
See application file for complete search history.

(56) References Cited

FOREIGN PATENT DOCUMENTS

| | | | | | |
|---|---|---|---|---|---|
| CN | 104406350 | A | | 3/2015 | |
| CN | 104880000 | A | | 9/2015 | |
| CN | 105928290 | A | | 9/2016 | |
| CN | 106288593 | A | | 1/2017 | |
| CN | 108534427 | | * | 4/2018 | ..... F25D 21/04 |
| CN | 108870833 | A | | 11/2018 | |
| CN | 109990527 | A | | 7/2019 | |
| DE | 293320 | A5 | | 8/1991 | |
| DE | 102011050691 | | * | 11/2012 | ..... F25D 17/042 |
| KR | 2000-0020426 | A | | 4/2000 | |
| KR | 10-2011-0100086 | A | | 9/2011 | |

OTHER PUBLICATIONS

English language translation of CN 108534427 to Xu. Translated Apr. 2023 (Year: 2018).*

* cited by examiner

AIR DUCT SYSTEM AND A REFRIGERATION APPLIANCE HAVING THE SAME

BACKGROUND

The present application is a 35 U.S.C. § 371 National Phase conversion of International (PCT) Patent Application No. PCT/CN2020/077546, filed on Mar. 3, 2020, which claims the priority of Chinese Patent Application No. 201910647038.0, filed on Jul. 17, 2019 and titled "Air Duct System and a Refrigeration Appliance Having the Same", which is incorporated herein by reference in its entirety. The PCT International Patent Application was filed and published in Chinese.

TECHNICAL FIELD

The present invention relates to the field of refrigeration appliance and particularly to an air duct system and a refrigeration appliance having the same.

Currently, in an air duct system, when air in a refrigeration compartment passes by a surface of an evaporator, the moisture in the air will condense on the surface of the evaporator. Since the evaporator is at a low temperature, the condensate water will be converted into frost after a period of time.

In the prior art, generally a defrosting heater is disposed nearby the evaporator and heats the frost on the evaporator to defrost. This defrosting manner is less efficient, increases the freezing load of the refrigerator, and finally reduces the cooling efficiency of the refrigerator.

Hence, it is necessary to provide an air duct system which avoids frosting on the evaporator.

SUMMARY

To solve the above technical problems, the present invention provides an air duct system avoiding frosting on the evaporator and a refrigeration appliance having the same.

To achieve the above object, the present invention employs the following technical solutions:

An air duct system, wherein the air duct system comprises a drying system and a cooling system which are arranged in cooperation with each other, the cooling system comprises an evaporator, and an air return port and an air supply port provided on two sides of the evaporator, the drying system is disposed between the air return port and the evaporator, and the drying system comprises an air compressor and an air storage tank that are connected to each other, so that the air discharged through the air return port sequentially passes through the air compressor and the air storage tank and then flows to the evaporator.

As a further improved technical solution of the present invention, wherein a bottom of the air storage tank is provided with a drainage outlet and a water drainage valve connected to the drainage outlet.

As a further improved technical solution of the present invention, wherein the air duct system further comprises at least one dryer which is disposed between the air storage tank and the evaporator.

As a further improved technical solution of the present invention, wherein the cooling system comprises a cooling chamber for receiving the evaporator, and the cooling chamber comprises a first opening connected to the drying system and a second opening connected to the air supply port.

As a further improved technical solution of the present invention, wherein the dryer is disposed in the first opening or disposed adjacent to the first opening.

As a further improved technical solution of the present invention, wherein there are two said dryers, and the other is disposed in the drying system and located at an output end of the air storage tank.

As a further improved technical solution of the present invention, wherein the air duct system further comprises a deodorizer which is disposed between the air storage tank and the first opening.

As a further improved technical solution of the present invention, wherein the air duct system comprises a first check valve disposed at the first opening, and a second check valve disposed at the second opening or the air supply port.

As a further improved technical solution of the present invention, wherein the drying system is provided with a drying compartment, and the air compressor and the air storage tank are both disposed in the drying compartment.

The invention also provides a refrigeration appliance having any of the said air duct system above, the refrigeration appliance comprises a cabinet having a refrigeration compartment, the air duct system is disposed on the cabinet and used to supply cool to the refrigeration compartment, and the air return port and the air supply port are disposed on an inner wall of the refrigeration compartment.

Advantageous effects of the present invention are as follows: in the air duct system and the refrigeration appliance having the same in the present invention, the drying system and the cooling system are arranged in cooperation with each other, so that the air discharged through the air return port sequentially passes through the air compressor and the air storage tank, and then flows to the evaporator so that the air passing through the evaporator is dried, thereby avoiding the frosting phenomenon, omitting the defrosting process, and avoiding problems such as the increase of the load and low efficiency.

BRIEF DESCRIPTION OF THE DRAWINGS

The figures presented here are used to provide further understanding of the present application and constitute a portion of the present application. The exemplary embodiments of the present application and the description thereof are used to explain the present application, and are not intended to limit the present application. In the figures.

DETAILED DESCRIPTION

To make the objects, the technical solutions and advantages of the present application more apparent, the technical solutions of the present application will be described clearly and completely in conjunction with specific embodiments and corresponding figures. Based on embodiments in the present application, all other embodiments obtained by those having ordinary skill in the art without making inventive efforts all fall within the extent of protection of the present application.

Figure 1:
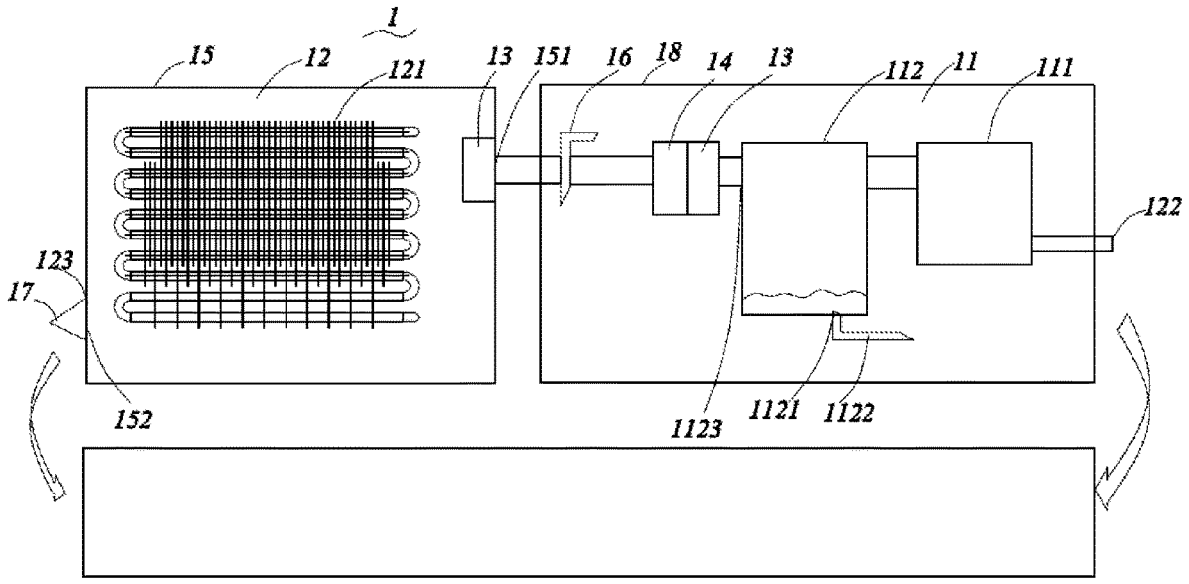
FIG. 1 is a schematic view of an air duct system of the present invention.

As shown in FIG. 1, the present invention provides an air duct system 1 for supplying cold air to a refrigeration compartment. The air duct system 1 comprises a drying system 11 and a cooling system 12 which are arranged in cooperation with each other.

The cooling system 12 comprises an evaporator 121, and an air return port 122 and an air supply port 123 provided on two sides of the evaporator 121, and the drying system 11 is disposed between the air return port 122 and the evaporator 121 so that the air flowing towards the evaporator 121 is dried, thereby avoiding the frosting phenomenon.

Specifically, the cooling system 12 is provided with a cooling chamber 15, and the evaporator 121 is disposed in the cooling chamber 15. To avoid leakage of cold, the said cooling chamber 15 is usually enclosed by a thermal insulating material; in the present embodiment, the drying system 11 is disposed outside the cooling chamber 15, and supplies dried air to the cooling chamber 15, thereby reducing the space occupied by the cooling chamber 15 so that the drying system 11 may utilize other external space which don't need to be thermally insulated. Certainly, as another preferred embodiment of the present invention, the drying system 11 may also be disposed in the cooling chamber 15.

In the present embodiment, the cooling chamber 15 has a first opening 151 connected to the drying system 11 and a second opening 152 connected to the air supply port 123. The first opening 151 and the second opening 152 are respectively located on two sides of the evaporator 121, so that the dry air discharged from the drying system 11 enters the cooling chamber 15 through the first opening 151, then flows to the evaporator 121, and then is discharged out of the air supply port 123 through the second opening 152.

Preferably, in the present embodiment, the air duct system 1 further comprises a first check valve 16 disposed at the first opening 151, and a second check valve 17 disposed at the second opening 152 or the air supply port 123; the first check valve 16 is capable of preventing reverse flow of air discharged from the drying system 11, and the second check valve 17 is capable of preventing reverse flow of air discharged from the air supply port 123.

Figure 2:
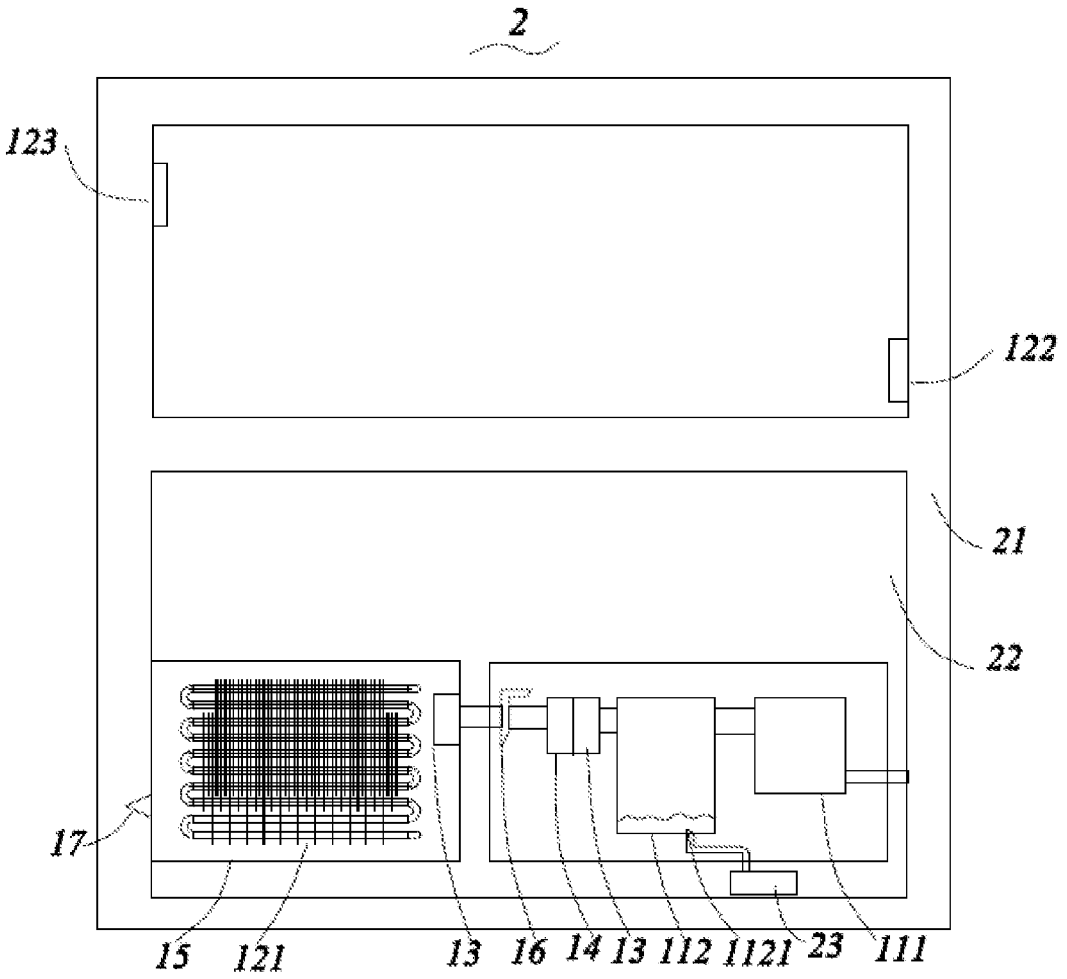
FIG. 2 is a schematic view of a refrigeration appliance having the air duct system of FIG. 1.

As shown in FIG. 1 and FIG. 2, the drying system 11 comprises an air compressor 111 and an air storage tank 112 that are connected to each other, so that the air discharged through the air return port 122 sequentially flows through the air compressor 111, the air storage tank 112 and then to the evaporator 121.

Specifically, the air compressor 111 draws and compresses air from the air return port 122 to reduce the saturation of water vapor, so that most of the water vapor in the air storage tank 112 is condensed into water, in order to dry the air passing through the evaporator 121, avoiding the frosting phenomenon, omitting the defrosting process, and avoiding problems such as the increase of the load and low efficiency.

Wherein the bottom of the air storage tank 112 is provided with a drainage outlet 1121 and a water drainage valve 1122 connected to the drainage outlet 1121, so that the condensed water is discharged to the external through the water drainage valve 1122.

In order to further ensure the drying effect, the air duct system 1 of the present invention is further provided with at least one dryer 13. The dryer 13 is disposed between the air storage tank 112 and the evaporator 121 to further dry the air, ensure that the air discharged to the evaporator 121 is dry air and avoid frosting on the evaporator 121.

In a specific embodiment of the present invention, as shown in FIG. 1, there are two said dryers 13, a second dryer 13 of which is disposed close to the air storage tank 112, and a first dryer 13 is disposed close to the evaporator 121, so that the air after being discharged from the air storage tank 112 flows through the dryers 13 and then to the evaporator 121. The two dryers 13 can further dry the air.

Specifically, the first dryer 13 disposed close to the evaporator 121 is disposed in the first opening 151 or disposed adjacent to the first opening 151. The second dryer 13 disposed close to the air storage tank 112 is directly disposed at an output end 1123 of the air storage tank 112.

Furthermore, in the present invention, the air duct system 1 further comprises at least one deodorizer 14. In the present embodiment, as shown in FIG. 1, at least one deodorizer 14 is disposed between the air storage tank 112 and the first opening 151 to remove the odor in the air. Certainly, the deodorizer 14 may also be disposed between the evaporator 121 and the air supply port 123, so that the air discharged from the air supply port 123 is free of the odor.

In addition, as a preferred embodiment of the present invention, in order to facilitate an operation such as installation, the drying system 11 is provided with a drying compartment 18, and the air compressor 111 and the air storage tank 112 are both disposed in the drying compartment 18. However, the drying system 11 is still connected the air compressor 111 and the air return port 122 through a pipeline or air duct, and the drying system 11 is communicated with the cooling chamber 15 through a pipeline or air duct.

Certainly, the air compressor 111 and the air storage tank 112 may also be set to an open type, which facilitates the heat dissipation of the air compressor 111.

As shown in FIG. 2, the present invention further provides a refrigeration appliance 2 having any air duct system 1 as described above. The refrigeration appliance 2 comprises a cabinet 21 having a refrigeration compartment 22, the air duct system 1 is disposed on the cabinet 21 and used to supply cool to the refrigeration compartment 22, and the air return port 122 and the air supply port 123 are disposed on the inner wall of the refrigeration compartment 22, so that the air in the refrigeration compartment 22, after being discharged through the air return port 122, is sequentially dried through the air compressor 111 and the air storage tank 112, then flows to the evaporator 121 for cooling, then is discharged through the air supply port 123 to the refrigeration compartment 22, so that the air passing through the evaporator 121 is dried, thereby avoiding the frosting phenomenon, omitting the defrosting process and improving the cooling efficiency of the refrigeration appliance 2.

The refrigeration appliance 2 further comprises a water collecting box 23 arranged in the cabinet 21, and the drainage outlet 1121 of the air storage tank 112 is connected with the water collecting box 23, thereby preventing water from flowing to the external and causing possible safety hazards, and meanwhile improving the heat dissipation efficiency of the refrigeration appliance 2.

In summary, in the air duct system 1 and the refrigeration appliance 2 having the same in the present invention, the drying system 11 and the cooling system 12 are arranged in cooperation with each other, so that the air discharged through the air return port 122 sequentially passes through the air compressor 111 and the air storage tank 112, and then flows to the evaporator 121 so that the air passing through the evaporator 121 is dried, thereby avoiding the frosting phenomenon, omitting the defrosting process, and avoiding problems such as the increase of the load and low efficiency.

What are described above are only preferred embodiments of the present invention. It should be appreciated that those having ordinary skill in the art may make several variations and improvements without departing from the inventive ideas of the present invention, which all fall within the extent of protection of the present invention.

What is claimed is:

1. An air duct system, wherein the air duct system comprises a drying system and a cooling system which are arranged in cooperation with each other, the cooling system comprises an evaporator, and an air return port and an air supply port provided on two sides of the evaporator, the drying system is disposed between the air return port and the evaporator, and the drying system comprises an air compressor and an air storage tank that are connected to each other, so that the air discharged through the air return port sequentially passes through the air compressor and the air storage tank and then flows to the evaporator;

wherein the air duct system further comprises at least one first dryer which is disposed between the air storage tank and the evaporator;

wherein the cooling system comprises a cooling chamber for receiving the evaporator, and the cooling chamber comprises a first opening connected to the drying system and a second opening connected to the air supply port;

wherein the first dryer is disposed in the first opening or disposed adjacent to the first opening.

2. The air duct system according to claim 1, wherein a bottom of the air storage tank is provided with a drainage outlet and a water drainage valve connected to the drainage outlet.

3. A refrigeration appliance having the air duct system according to claim 2, wherein the refrigeration appliance comprises a cabinet having a refrigeration compartment, the air duct system is disposed on the cabinet and used to supply cool to the refrigeration compartment, and the air return port and the air supply port are disposed on an inner wall of the refrigeration compartment.

4. The air duct system according to claim 1, wherein the system comprises a second dryer, and the second dryer is disposed in the drying system and located at an output end of the air storage tank.

5. A refrigeration appliance having the air duct system according to claim 4, wherein the refrigeration appliance comprises a cabinet having a refrigeration compartment, the air duct system is disposed on the cabinet and used to supply cool to the refrigeration compartment, and the air return port and the air supply port are disposed on an inner wall of the refrigeration compartment.

6. The air duct system according to claim 1, wherein the air duct system further comprises a deodorizer which is disposed between the air storage tank and the first opening.

7. A refrigeration appliance having the air duct system according to claim 6, wherein the refrigeration appliance comprises a cabinet having a refrigeration compartment, the air duct system is disposed on the cabinet and used to supply cool to the refrigeration compartment, and the air return port and the air supply port are disposed on an inner wall of the refrigeration compartment.

8. The air duct system according to claim 1, wherein the air duct system comprises a first check valve disposed at the first opening, and a second check valve disposed at the second opening or the air supply port.

9. A refrigeration appliance having the air duct system according to claim 8, wherein the refrigeration appliance comprises a cabinet having a refrigeration compartment, the air duct system is disposed on the cabinet and used to supply cool to the refrigeration compartment, and the air return port and the air supply port are disposed on an inner wall of the refrigeration compartment.

10. The air duct system according to claim 1, wherein the drying system is provided with a drying compartment, and the air compressor and the air storage tank are both disposed in the drying compartment.

11. A refrigeration appliance having the air duct system according to claim 10, wherein the refrigeration appliance comprises a cabinet having a refrigeration compartment, the air duct system is disposed on the cabinet and used to supply cool to the refrigeration compartment, and the air return port and the air supply port are disposed on an inner wall of the refrigeration compartment.

12. A refrigeration appliance having the air duct system according to claim 1, wherein the refrigeration appliance comprises a cabinet having a refrigeration compartment, the air duct system is disposed on the cabinet and used to supply cool to the refrigeration compartment, and the air return port and the air supply port are disposed on an inner wall of the refrigeration compartment.

* * * * *